US006000773A

United States Patent [19]

Murray et al.

[11] Patent Number: 6,000,773

[45] **Date of Patent: *Dec. 14, 1999**

[54] INK JET PRINTER HAVING INK USE INFORMATION STORED IN A MEMORY MOUNTED ON A REPLACEABLE PRINTER INK CARTRIDGE

[75] Inventors: Richard A. Murray; Dan J. Dull, both of San Diego, Calif.

[73] Assignee: ENCAD, Inc., San Diego, Calif.

[ * ] Notice: This patent is subject to a terminal disclaimer.

[21] Appl. No.: 08/812,176

[22] Filed: Mar. 6, 1997

Related U.S. Application Data

[63] Continuation of application No. 08/287,907, Aug. 9, 1994, Pat. No. 5,610,635, and a continuation-in-part of application No. 08/287,650, Aug. 9, 1994, Pat. No. 5,646,660.

[51] Int. Cl.[6] ..... B41J 2/175

[52] U.S. Cl. ..... 347/7; 347/87

[58] Field of Search ..... 347/7, 19, 86, 347/87

[56] References Cited

U.S. PATENT DOCUMENTS

| | | | |
|---|---|---|---|
| 3,946,398 | 3/1976 | Kyser et al. . | |
| 4,771,295 | 9/1988 | Baker et al. . | |
| 5,049,898 | 9/1991 | Arthur et al. . | |
| 5,059,989 | 10/1991 | Eldridge et al. . | |
| 5,068,806 | 11/1991 | Gatten . | |
| 5,103,246 | 4/1992 | Dunn . | |
| 5,122,812 | 6/1992 | Hess et al. . | |
| 5,265,315 | 11/1993 | Hoisington et al. . | |
| 5,270,730 | 12/1993 | Yaegashi et al. . | |
| 5,278,584 | 1/1994 | Keefe et al. . | |
| 5,280,300 | 1/1994 | Fong et al. . | |
| 5,300,959 | 4/1994 | McClelland et al. . | |
| 5,365,312 | 11/1994 | Hillmann et al. . | |
| 5,414,452 | 5/1995 | Accatino et al. . | |
| 5,439,302 | 8/1995 | Andou et al. . | |
| 5,583,547 | 12/1996 | Gast et al. . | |
| 5,610,635 | 3/1997 | Murray et al. | 347/7 |
| 5,646,660 | 7/1997 | Murray et al. | 347/59 |

FOREIGN PATENT DOCUMENTS

| | | |
|---|---|---|
| 0 412 459 A2 | 2/1991 | European Pat. Off. . |
| 0 571 093 A2 | 11/1993 | European Pat. Off. . |
| 0 589 581 A2 | 3/1994 | European Pat. Off. . |
| 62-030042 | 2/1987 | Japan . |
| 62-158049 | 7/1987 | Japan . |
| WO 90/00974 | 2/1990 | WIPO . |

OTHER PUBLICATIONS

Hewlett Packard Printer Ink Jet Cartridge Part No. HP5164 for use with Deskjet 1200 Printer, Summer 1993. (Photograph #1).

Hewlett Packard Printer Ink Jet Cartridge Part No. HP5164 for use with Deskjet 1200 Printer, Summer 1993. (Photograph #2).

Encad Part No. 201810 Ink Jet Cartridge which is compatible with the Hewlett Packard Deskjet Printer, 1992. (Photograph #3).

Encad Part No. 201810 Ink Jet Cartridge which is compatible with the Hewlett Packard Deskjet Printer, 1992. (Photograph #4).

Encad Part No. 201810 Ink Jet Cartridge which is compatible with the Hewlett Packard Deskjet Printer, 1992. (Photograph #5).

Xerox Printer Cartridge and Jet Plate, 1992. (Photograph #6).

Xerox Printer Cartridge and Jet Plate, 1992. (Photograph #7).

(List continued on next page.)

*Primary Examiner*—Huan Tran

*Attorney, Agent, or Firm*—Knobbe, Martens, Olson & Bear, LLP

[57] ABSTRACT

An ink jet printer cartridge includes a memory storage element mounted on a side surface thereof. The memory storage element stores information about ink expelled from the cartridge. The information is routed from the memory storage element to an external device, and the user may be warned when cartridge replacement is advisable.

5 Claims, 6 Drawing Sheets

OTHER PUBLICATIONS

Cannon Bubble Jet BC–2 Ink Jet Cartridge and Jet Plate, 1992. (Photograph #8).
Cannon Bubble Jet BC–2 Ink Jet Cartridge and Jet Plate, 1992. (Photograph #9).
Cannon Bubble Jet BC–2 Ink Jet Cartridge and Jet Plate, 1992. (Photograph #10).
Cannon Bubble Jet BC–2 Ink Jet Cartridge and Jet Plate, 1992. (Photograph #11).
Slides from presentation by Xerox, Inc. at BIF Injet Conference, Hamburg, Germany, Mar. 1994, pp. 1–7.

Aden, et al., "The Third–Generation HP Thermal InkJet Printhead", *Hewlett–Packard Journal*, pp. 41–44, Feb. 1994.

Platform Development Team, "Development of the HP Deskjet 1200C Print Cartridge Platform", *Hewlett–Packard Journal*, pp. 46–54, Feb. 1994.

"Automated Assembly of the HP DeskJet 500C/Desk Writer C Color Print Cartridge", *Hewlett–Packard Journal*, pp. 76–83, Aug. 1992.

INK JET PRINTER HAVING INK USE INFORMATION STORED IN A MEMORY MOUNTED ON A REPLACEABLE PRINTER INK CARTRIDGE

CROSS REFERENCE TO RELATED APPLICATIONS

This application is a continuation of U.S. patent application Ser. No. 08/287,907 entitled "PRINTER INK CARTRIDGE WITH MEMORY STORAGE CAPACITY", now U.S. Pat No. 5,610,635, and a continuation-in-part of U.S. patent application Ser. No. 08/287,650 entitled "PRINTER INK CARTRIDGE WITH DRIVE LOGIC INTEGRATED CIRCUIT", now U.S. Pat. No. 5,646,660, both of which were filed on Aug. 9, 1994. The disclosures of both of the above-described patent applications are hereby incorporated by reference in their entirety.

BACKGROUND OF THE INVENTION

1. Field of the Invention

The present invention relates generally to the field of printer ink cartridges and, more specifically, to printer ink cartridges which include the capacity to store information on the printer ink cartridge.

2. Description of the Related Technology

Ink cartridges are used in ink jet printers, a class of noncontact printers characterized by rapid heating and expulsion of ink from nozzles onto paper. Many printer ink cartridges are passive devices, i.e., use passive components on a jet plate assembly, such as resistors, to heat the ink in the cartridge to a point that it will expel from jet nozzles or openings in the jet plate. The resistors are formed utilizing thick or thin film technology on a substrate. Typically, one resistor per orifice or jet is required. These passive printer ink cartridges are "dumb" devices because they require an interface to control and driver circuitry on the printer to determine when each nozzles on the cartridge is to be fired.

The printer sends control signals to the resistors on the cartridge to control the firing sequence of the jets as the cartridge moves along the page. One of the first printer ink cartridges that used this passive design was designed by Hewlett-Packard in approximately 1984 and was sold under the trade name ThinkJet Cartridge. The Thinkjet Cartridge had 12 jet nozzles and required 13 interconnect lines to the printer system to control the application of ink by the cartridge. The design and operation of the ThinkJet cartridge is described in more detail in an article entitled, "History of Thinkjet Printhead Development", published in *The Hewlett-Packard Journal* dated May 1985.

In approximately 1987, Hewlett-Packard developed the DeskJet thermal inkjet cartridge which increased the number of jets on the printer ink cartridge to fifty. However, the DeskJet Cartridge is also a passive device that requires an interface to control and driver circuits on the printer to activate the jets. The DeskJet cartridge has fifty jets and requires fifty-six interconnect lines to the printer system to control the application of ink by the cartridge. The design and operation of the original DeskJet cartridge is described in more detail in an article entitled, "Low Cost Plain Paper Printing," published in *The Hewlett-Packard Journal* dated August 1992.

Recently, Hewlett-Packard designed a thermal printer ink cartridge, Part No. HP51640, used in a DeskJet 1200 printer also by Hewlett-Packard which incorporated a portion of the driver electronics and some control logic onto the jet plate of the printer ink cartridge. In this particular case, the jet plate is composed of the following structures: (1) at silicon substrate which houses the driver control circuitry for each jet, (2) some control logic circuitry to determine which jet is to be fired, and (3) the heat generating resistors. Since the driver control circuitry and the control logic circuitry is proximate to the heat generating resistors, the driver control logic circuitry is susceptible to the heat generated by the heat generating resistors. The jet plate is located proximate to the jet nozzles to heat the ink for expulsion. The design and operation of the DeskJet 1200 cartridge is described in more detail in two articles entitled, "The Third-Generation HP Thermal InkJet Printhead" and Development of the HP DeskJet 1200C Print Cartridge Platform" published in *The Hewlett-Packard Journal* dated Feb. 1994.

In addition, Canon has incorporated the driver circuitry and some control logic circuitry on the jet plate assembly in their BubbleJet BJ-02 cartridge, which was developed for use with the BubbleJet printer. The jet plate assembly on the BubbleJet cartridge is basically an aluminum plate which acts as a heat sink, a PC board, and a silicon substrate. The silicon substrate comprises some driver circuitry, some logic circuitry, and the heat generating resistors. The heat generating resistors are encapsulated and form little cave-like channels such that the ink is directed into the channels and then ejected through the process of heating the ink and causing bubbles to eject the ink across the silicon substrate. Since the ink comes into contact with the silicon substrate, the substrate must be protected by a barrier layer which is not effected by the chemicals in the ink.

In addition, none of the above cartridges have any memory storage capacity. Therefore, the cartridge is not able to store any data regarding the amount of ink remaining in the cartridge or the type or color of ink in the cartridge. Although, some cartridges contain some control and driver circuitry on the cartridge, the cartridge remains a dumb device because the cartridge cannot provide any information to the printer device concerning the status of the cartridge or the ink in the cartridge.

As is known to those of skill in the art of silicon circuit fabrication, the larger the circuit that is produced on a silicon substrate, the harder the circuit is to manufacture. In addition, as the size of the circuit increases, the yield of operable circuits that are produced decreases. Further, as the circuit size increases, the potential for long term reliability problems increases. Therefore, the manufacturing costs rise dramatically with the increased size of the circuit that is produced on silicon.

In the case of developing a silicon integrated circuit on a jet plate to drive and control the operation of the jets, a number of factors directly affect the size of the circuitry required. Initially, each jet nozzle requires one heating element, such as a resistor, one drive control circuit and one or more control signals to indicate when the jet nozzle is to be fired. As the number of jets increase, the size of the silicon substrate required to house the driver circuits, control circuits and the heating elements increases proportionally to the number of added jets. Also, the increased number of jets, for example 84 jets, requires a silicon die having an inefficient shape or having a large aspect ratio, i.e., a die having a long length and a short width, because the increased number of jets causes the die to increase in length. Both large dies and dies with a large aspect ratio are very difficult to manufacture, further decreasing processes yields and increasing production costs.

In addition to the problems of silicon yield for such large circuits, the circuitry on the jet plate must be able to withstand the heat generated by the resistors as well as problems associated with silicon coming into constant contact with moving heated ink. Therefore, the production of the silicon integrated circuit on the jet plate must include additional steps to prevent long-term degradation of the silicon due to contact with the chemicals in the ink, to cavitation problems caused by the moving ink, etc. These processes increase the production costs for making a jet plate. These same processes may also decrease the performance characteristics of the driver and logic circuits on the jet plate. Further, these processes cannot be used to form a memory device.

SUMMARY OF THE INVENTION

The invention comprises a method of accessing and using information stored in a memory storage element on a printer ink cartridge. The method includes mounting a memory storage element on a side surface of the printer ink cartridge which also contains electrical contacts for electronically interfacing with a movable print carriage. The method also includes storing in the memory storage element data indicative of an amount of ink expelled by the cartridge, routing this data from the memory storage element to an external device, analyzing the data in the external device to determine if the cartridge should be replaced, and warning an operator of the printer that the printer cartridge should be replaced in response to the analysis.

DETAILED DESCRIPTION OF THE PREFERRED EMBODIMENTS

Figure 1:
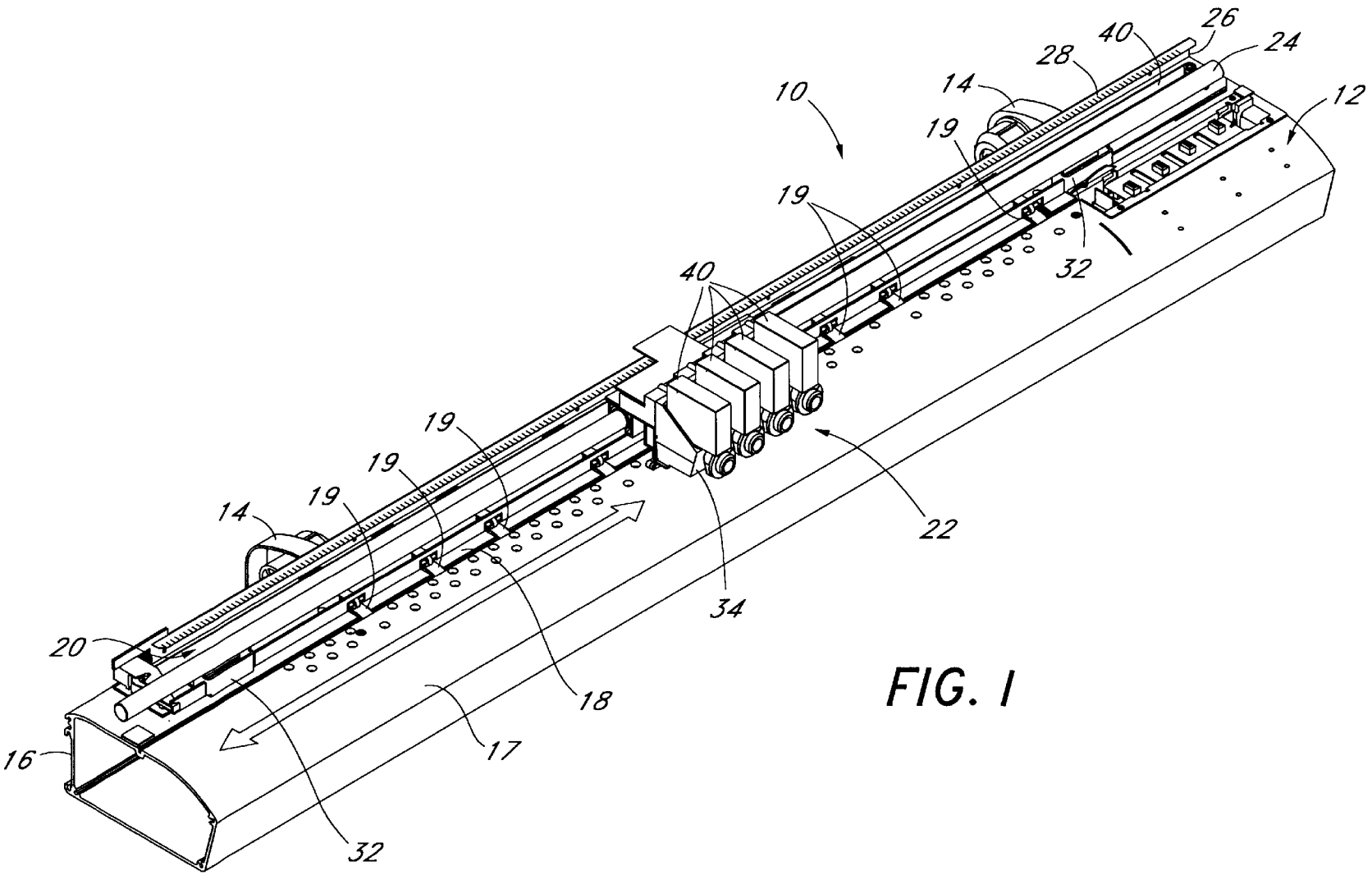
FIG. 1 is a perspective view of a plurality of printer ink cartridges of the present invention installed in a typical printer/plotter carriage assembly.

The printer ink cartridge of the present invention is used in combination with a typical printer device which is described in association with FIG. 1. A printer carriage assembly 10 is supported on the top face of a printer housing 12, which is a part of a typical printer device. As an example of a printer device, the assignee of the present application sells a thermal ink jet printer device under the trade name of NovaJet II. An operations manual of the NovaJet II printer entitled "NovaJet II User's Guide" (Encad Part No. 202409) is hereby incorporated by reference. The housing 12 is supported by a pair of legs (not shown) and encloses various electrical and mechanical components related to the operation of the printer/plotter device, but not directly pertinent to the present invention.

A pair of slidable roll holders 14 is mounted to a rear side 16 of the housing 12. A roll of continuous print media (not shown) can be mounted on the roll holders 14 to enable a continuous supply of paper to be provided to the printer/plotter carriage assembly 10. Otherwise, individual sheets of paper may be fed into the rear side 16 of the housing as needed. A portion of a top side 17 of the housing 12 forms a platen 18 upon which the printing/plotting is performed by select deposition of ink droplets on to the paper. The paper is guided from the rear side 16 of the housing 10 under a support structure 20 and across the platen 18 by a plurality of drive rollers 19 which are spaced along the platen 18.

The support structure 20 is mounted to the top side 17 of the housing 12 with sufficient clearance between the platen 18 and the support structure 20 along a central portion of the platen 18 to enable a sheet of paper which is to be printed on to pass between the platen 18 and the support structure 20. The support structure 20 supports a print carriage 22 above the platen 18. The support structure 20 comprises a guide rod 24 and a coded strip support member 26 positioned parallel to the longitudinal axis of the housing 12.

The print carriage 22 comprises a plurality of printer cartridge holders 34 each with a printer cartridge 40 mounted therein. The print carriage 22 also comprises a split sleeve 36 which slidably engages the guide rod 24 to enable motion of the print carriage 22 along the guide rod 24 and to define a linear path, as shown by the bi-directional arrow in FIG. 1, along which the print carriage 22 moves. A motor (not shown) and drive belt mechanism 38 are used to drive the print carriage 22 along the guide rod 24.

Figure 3:
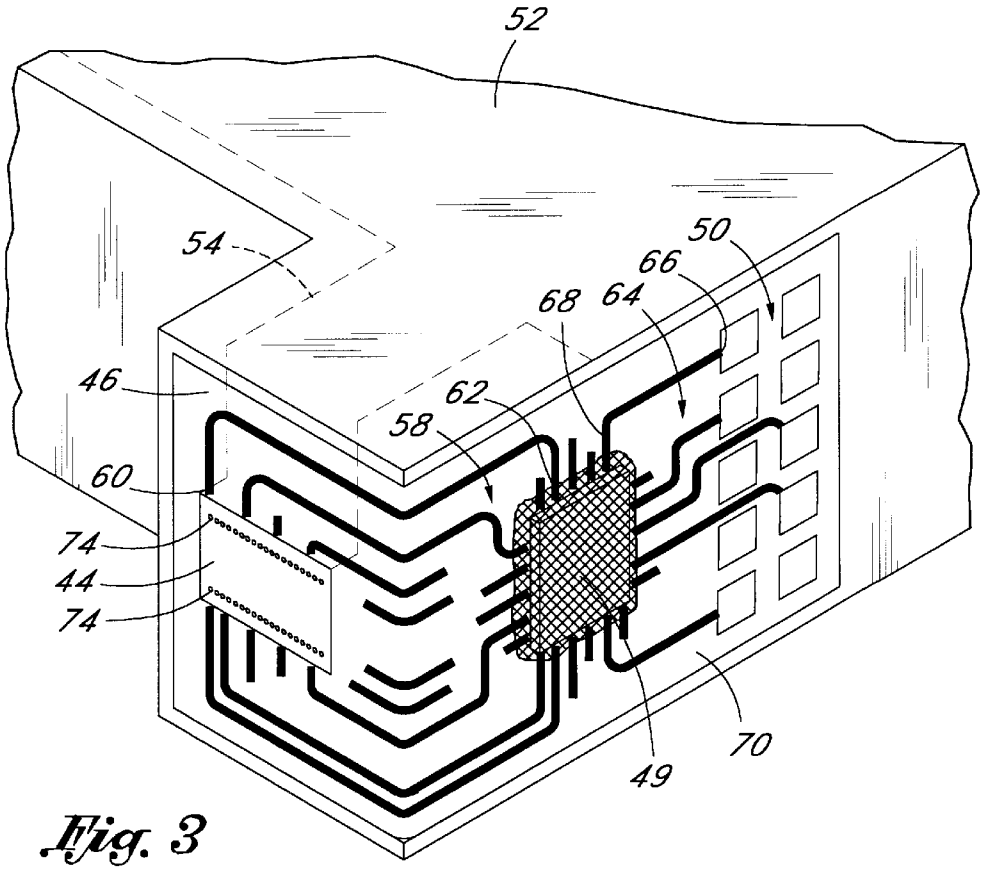
FIG. 3 is a cutaway perspective view of the printer ink cartridge of FIG. 2, illustrating the jet plate, flexible connector and integrated circuit.
Figure 2:
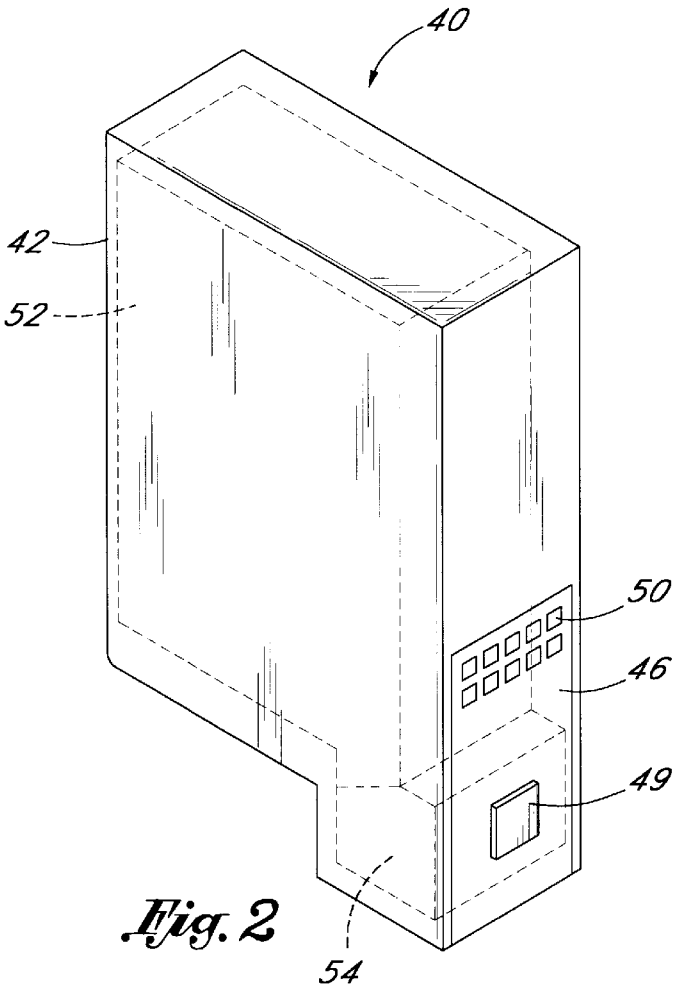
FIG. 2 is a perspective view of the preferred embodiment of the printer ink cartridge.

Focusing on the preferred embodiment of the printer ink cartridge 40 of the present invention, as illustrated in FIG. 2 and FIG. 3, the printer ink cartridge 40 comprises a cartridge body 42, a jet plate assembly 44, a plurality of electrical conductors formed into a flexible connector 46, a control and driver circuit 47 (FIG. 5), a memory storage element 48 (FIG. 5), and a first plurality of electrical contacts 50. In the preferred embodiment, the printer ink cartridge 40 is adapted for use with an ink jet printer. Preferably, the control and driver circuit 47 and the memory storage element 48 are formed on a single application specific integrated circuit (ASIC) 49. Alternatively, the control and driver circuit 47 and the memory storage element 48 can be formed on their own individual integrated circuit. The two individual integrated circuits are connected together by an additional plurality of conductors. In FIG. 2, the cartridge body 42 is shown as mostly rectangular due to the ease in which a rectangular cartridge body can be manufactured. As will be recognized by those of skill in the art, the cartridge body 42 may take on any number of shapes to accommodate the desired volume of ink and/or the envelope of a printer/plotter housing, if the cartridge 40 is enclosed within such a housing.

The cartridge body 42 further comprises an ink reservoir 52 and a manifold assembly in the area referred to as 54. The ink reservoir 52 may take on any number of shapes to accommodate a preferred volume of ink and to conform to the envelope of the cartridge body 42. The capacity of the ink reservoir 52 of the one embodiment is 120 ml of ink. The manifold assembly 54 is designed to route the ink from the reservoir 52 at a desired flow rate and to deliver a desired volume of ink to the jet plate assembly 44 (FIG. 3). The design of such a manifold 54 is known to those of skill in the art.

Referring now to FIG. 3, the flexible connector 46 preferably comprises a first plurality of electrical conductors 58, wherein one side 60 of each of the first plurality of conductors 58 is connected to the jet plate assembly 44. An opposite side 62 of each of the first plurality of electrical conductors 58 is connected to the integrated circuit 49 to electrically interconnect the jet plate assembly 44 and the drive control logic integrated circuit 49. A second plurality of electrical conductors 64 on the flexible electrical connector 46 terminate at one end 66 into the first plurality of electrical contacts 50 and are connected at an opposite end 68 to the integrated circuit 49. Preferably, the first and second plurality of electrical conductors 58, 64 are encased in a polymeric flexible coating. In the preferred embodiment, the polymeric flexible coating comprises Kapton tape 70, available from 3M Corporation. The preferred layout of the electrical conductors 58, 64 on the flexible connector 46 is described in more detail below in association with FIG. 6.

The first plurality of contacts 50 are preferably coated with a conductive metal, such as gold, to provide a conductive surface. In one embodiment, the electrical contacts 50 are exposed contacts. The contacts 50 are used to communicate with a device (e.g., printer system 91, FIG. 5) remote from the printer cartridge 40. Preferably, each of the first plurality of electrical contacts 50 on the flexible connector 46 mate with a corresponding one of a second plurality of electrical contacts (not shown) on the printer cartridge holders 34 (FIG. 1) to receive/transmit information to/from the printer system 91 (FIG. 5).

Figure 4:
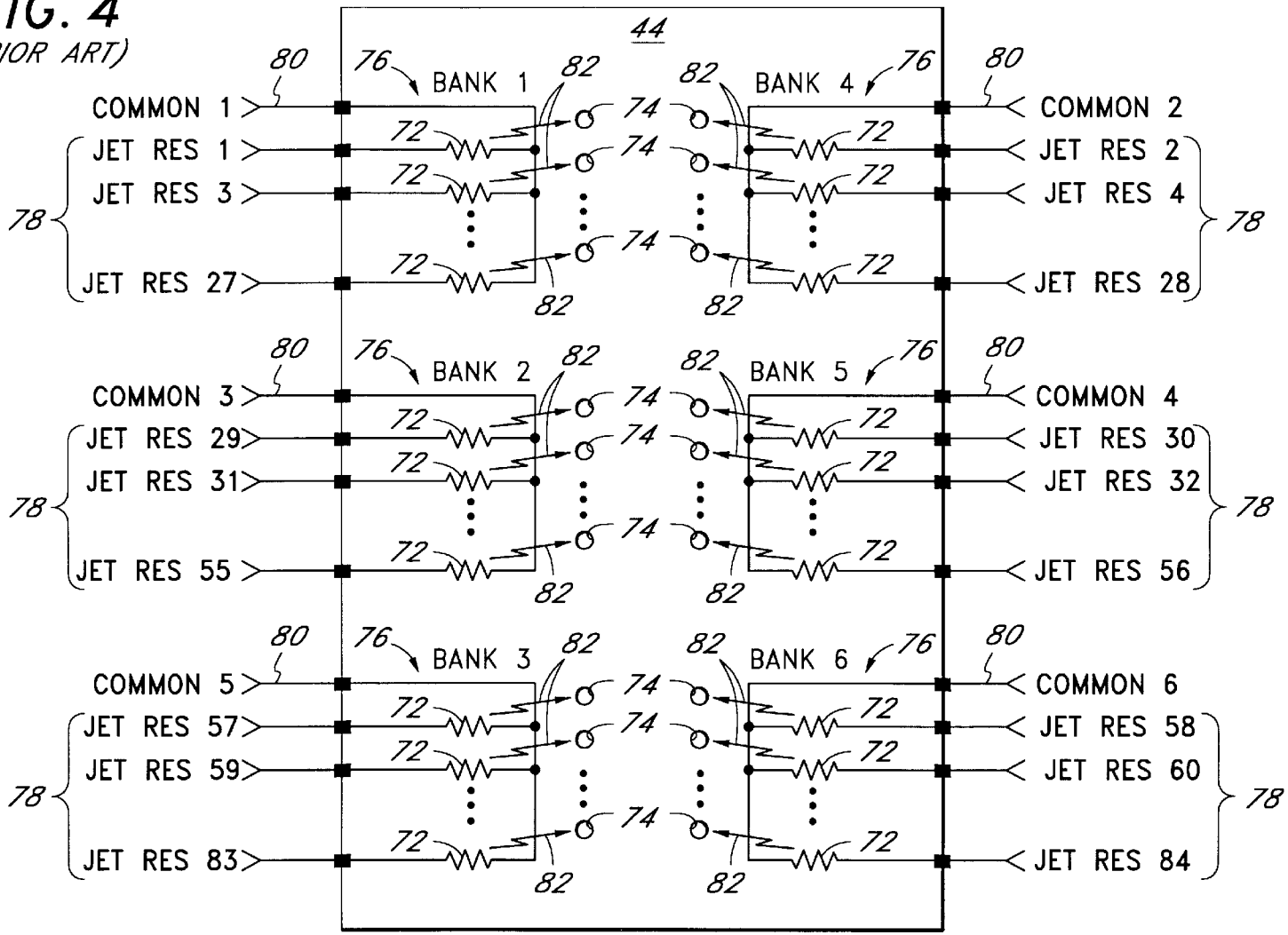
FIG. 4 (PRIOR ART)
FIG. 4 is a schematic diagram of the jet plate in communication with the plurality of jets.

The jet plate 44 preferably comprises a plurality of heating elements 72 and a plurality of ink channels (not shown). In a preferred embodiment as illustrated in FIG. 4, the heating elements 72 are resistors. In addition, the jet plate assembly 44 is associated with a plurality of ink ejection orifices 74, also referred to as nozzles or jets. In the preferred embodiment there are eighty-four ink ejection orifices 74. The eighty four ink ejection orifices 74 are divided into six banks 76 of fourteen ink ejection orifices 74. Each of the plurality of ink ejection orifices 74 is located proximate to an associated ink channel (not shown) and an associated heating element 72 on the jet plate 44. Each of the plurality of ink channels routes ink from the manifold 54 to its associated ink ejection orifice 74. Each heating element 72 is located proximate to its associated ink ejection orifice 74 to enable the direct heating of the ink delivered by its associated channel. The plurality of heating elements 72 on the jet plate 44 are connected to a set of driver signal lines 78 and a set of control signal lines 80 generated by the control and driver logic circuit 47 (FIG. 1) to receive energization signals to control the firing sequence of the ink ejection orifices 74. As illustrated in FIG. 4, all of the heating elements 72 in a bank are connected at one end to one of the set of control signal lines 80 assigned to the bank 76. Each of the opposite ends of the heating elements 72 is connected to an associated one of the set of driver signal lines 78. In the preferred embodiment, the set of driver signal lines 78 comprises eighty-four signal lines, i.e., one driver signal line 78 for each heating element 72, and the set of control signal lines 80 comprises six signal lines, i.e., one control signal line 80 for each bank 76 of ink ejection orifices 74. In the preferred embodiment, the set of driver signal lines 78 comprise the signals Jet Res0, Jet Res1 . . . Jet Res84, the set of which are referred to as the Jet Res[1:84] signal lines 78. In the preferred embodiment, the set of control signal lines 80 comprise the signals Common1, Common2, Common3, Common4, Common5 and Common6, the set of which are referred to as the Common[1:6] signal lines 80. Upon the receipt of the energization signals, the heating element 72 heats the ink to a vaporization point until it is expelled through the associated ink ejection orifice 74. The heating and expulsion of the ink is symbolized by the arrows 82 in FIG. 4. The design of such a jet plate assembly 44 is known to those of skill in the art and is described in an article entitled, "Low Cost Plain Paper Printing," published in *The Hewlett-Packard Journal* dated Aug. 1992.

Figure 5:
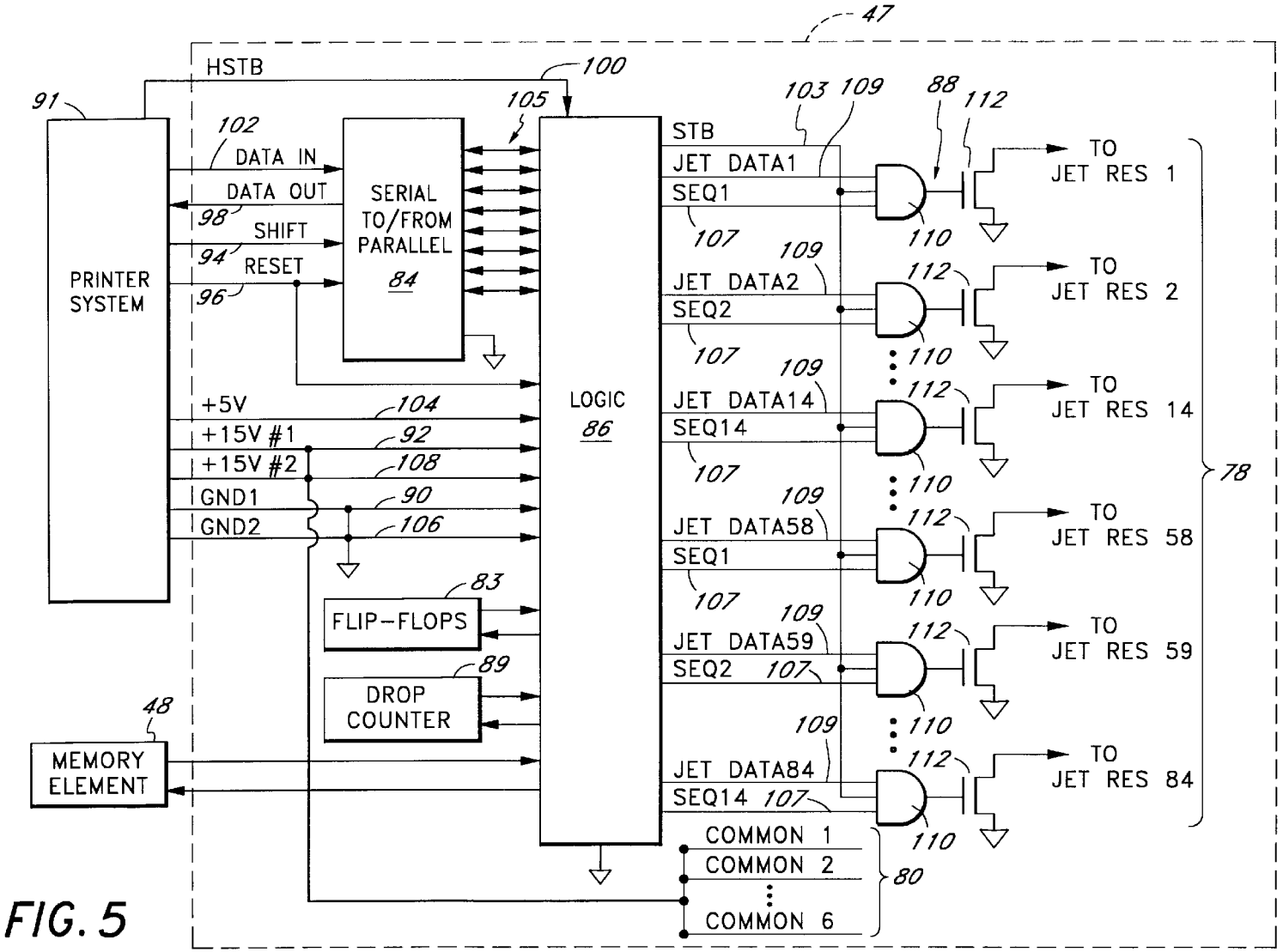
FIG. 5 is a block diagram of the control and driver circuit in combination with the memory storage element.

FIG. 5 illustrates a schematic block diagram of the control and driver circuit 47 and the memory storage element 48. The memory storage element 48 is preferably connected to the control and driver circuit 47 to enable information to be routed from an external system, such as a printer system 91, to the memory storage element 48. In a preferred embodiment, the memory storage element 48 is an EEPROM. In an alternate embodiment, the memory storage element 48 is a flash memory. In another alternate embodiment, the memory storage element 48 is a one time programmable read only memory (PROM). In a further alternate embodiment, the memory storage element 48 is a RAM, wherein the RAM is connected to a battery power supply on the RAM chip which enables the RAM to store data when the cartridge 40 is not connected to an external device. These types of RAM and battery power supply units, also referred to as nonvolatile RAM, are know to those of skill in the art, such as the DS 1220AB/AD manufactured by Dallas Semiconductor. Any other type of memory storage element 48 known to those of skill in the art may be utilized so long as the memory element 48 is able to store data when external power is not applied to the cartridge 40.

As is known to those of skill in the art, nonvolatile memory storage units, such as EEPROM and flash memory can require a large amount of time to access. In a preferred embodiment, in addition to the circuitry described below, the control and driver circuit 47 comprises a plurality of flip-flops 83. The flip-flops 83 are temporary storage devices from which data can be retrieved quicker than from the memory storage element 48. Data from the memory storage element 48 which need to be accessed quickly is transferred to the plurality of flip-flops 83 for easy access. When the cartridge is about to be powered down, the data stored in the temporary flip-flops 83 may be transferred to the memory storage element 48 for nonvolatile storage. This nonvolatile storage feature is advantageous because the printer can be turned off or the printer ink cartridge 40 can be removed from the printer and the memory storage element 48 will still retain the data in the nonvolatile memory on the cartridge 40.

The control and driver circuit 47 preferably comprises the following components: a serial to/from parallel converter 84, a logic block 86 and a plurality of driver circuits 88. Each of the driver circuits 88 preferably comprises an AND gate 110 and a transistor 112. In a preferred embodiment, the control and driver circuit 47 further comprises a counter 89. Electrical lines conduct the following power and control signals to/from an external device, such as a printer system 91: a first ground signal 90, a first +15V power signal 92, a shift signal 94, a reset signal 96, a DATA OUT (DOUT) signal 98, a head strobe (HTSB) signal 100, a DATA IN (DIN) signal 102, a +5V power signal 104, a second ground signal 106 and a second +15V signal 108. The first +15V power signal 92 and the second +15V power signal 108 are connected together in the control and driver circuit 47 and deliver +15V to the Common[1:6] signals 80 and to the logic block 86 when power is applied to the printer cartridge 40 from the external device.

Preferably, data is delivered from the external system 91, such as a printer system, to the ink cartridge 40 (FIG. 2) on the DATA IN (DIN) line 102. The shift signal 94 is used to synchronize the data sent to/received from the printer ink cartridge 40 to the clock rates on the external system 91.

With each rising clock edge of the shift signal 94, one bit of data on the DATA IN line 102 is shifted into the serial to/from parallel converter 84. The serial to/from parallel converter 84 continues to receive data on the DATA IN line 102 until the serial to/from parallel converter 84 is full. Once the serial to/from parallel converter 84 is full, a parallel word of data 105 is shifted out of the converter 84 and into the logic block 86.

The parallel word of data 105 may contain both command bits and data bits. The command bits indicate to the logic block 86 the location that the data bits are to be routed and/or the type action that the logic block 86 should perform on the data bits. For example, if the command bits indicate that a heating element 72 (FIG. 4) is to be energized, the data bits delivered to the logic block 86 contain the address of the specific jet 74 (FIG. 4) in a bank 76 of ink ejection orifices 74 that is to be energized and the firing data for the specific ink ejection orifice 74 in the bank 76 that is delivered to the logic block 86. Upon receiving the energize an ink ejection orifice command, the logic block 86 processes the received data bits and activates one of a set of sequence control signals on the line 107, SEQ[1:14], indicating which of the fourteen ink ejection orifices 74 in a given bank 76 that is to be fired. Preferably, the sequence control signals on the lines 107, i.e., SEQ[1:14], representing each orifice 74 in a given bank 76 is automatically cycled though for each bank 76 in rapid succession. The sequence control signals on the lines 107 are delivered from the logic block 86 to the AND gate 110 of the driver circuit 88.

Also from the parallel word of data 105, a plurality of jet data signals on the lines 109 indicate if the addressed jet is to be fired or to be skipped. The jet data signals on the lines 109 are delivered from the logic block 86 to the AND gate 110 of the driver circuit 88. If the jet data signal 109 is at a logic high level, the jet is to be fired. If the jet data signal 109 is at a logic low level, the jet is to be skipped.

When the addressed jet is to be activated, the head strobe signal (HTSB) 100 is received from the printer system at a logic low level. The HTSB signal 100 is inverted and gated with other signals in the logic block 86 and is output by the logic block as an STB signal on the line 103. The STB signal on the line 103 is delivered to each of the AND gates 110 of the driver circuits 88. The receipt of a logic high STB signal 103, a logic high jet data signal 109 and a logic high, or active, sequence control signal 107 activates the AND gate 110 of the addressed driver circuit 88. The logic high level, or active, output of the AND gate 110 causes the transistor 112 of the driver circuit to be active. The active transistor 112 connects the driver signal line 78 assigned to the addressed jet number, i.e., the appropriate Jet Res[1:84] signal lines 78, to the first ground signal 90.

Now referring to FIGS. 4 and 5, the Common[1:6] signals are connected to +15V on one end. The activated driver signal 78, i.e., the active Jet Res[1:84] signal, delivers a first ground signal 90 to an opposite side of the addressed heating element 72. The remainder of the driver circuits 88 which are not activated have a +15V Common[1:6] signal connected to one end and a deactivated transistor 112 at the opposite end, therefore no current flows though these heating elements 72. The addressed heating element 72 which has a +15V Common[1:6] signal 80 connected to one end and a grounded Jet Res[1:84] signal 78 connected to the other end will have a sufficient current flow though the heating element 72, such as a resistor, to energize the heating element 72. Once the heating element 72 is energized, the ink is heated and the ink ejection orifice 74 is fired.

In FIG. 5, if the command bits from the parallel word 105 indicate that data, such as ink type, ink color, lot number of the ink, etc., is to be stored in the memory storage element 48, the data bits from the parallel word 105 delivered to the logic block 86 contain the address location and the data that is to be stored in the storage element 48. Upon receiving the store data command, the logic block 86 first routes the address of the location where the data is to be stored to the memory storage element 48. Then the logic block 86 routes the data to the memory storage element 48 for storage.

If the command bits indicate that data, such as ink color, data from a spectral analysis of the ink, initial amount of ink stored in the cartridge body, remaining ink capacity, etc., is to be retrieved from the memory storage element 48, the data bits delivered to the logic block 86 contain the address location of the data that is to be retrieved from the storage element 48. Upon receiving the retrieve data command, the logic block 86 processes the data request and routes the address of the requested data to the memory storage element 48. The requested data from the memory storage element 48 is returned to the logic block 86 for routing to an external system 91.

If status information needs to be sent from the control and driver circuit 47 to the external system 91, such as in the case of a data request, a parallel word of data 105 is sent from the logic block 86 to the serial to/from parallel converter 84. Upon the receipt of each clock edge from the shift signal 94, one bit of data is shifted out of the serial to/from parallel converter 84 onto the DATA OUT (DOUT) line 98 and is delivered to the external system 91. If the external system 91 needs to reset the electronics of the control and driver circuit 47, a reset signal 96 from the external system is connected to the serial to/from parallel converter 84 and the logic block 86. When the external system 91 initiates a reset during power-up or any other reset situation, the receipt of the reset signal 96 causes the serial to/from parallel converter 84 and the logic block 86 to reset to a known initialization condition.

Preferably, the counter 89 is incremented each time a driver circuit 88 connected to one of the heating elements 72 is energized. In an alternate embodiment, the counter 89 is incremented each time a plurality of driver circuits 88 are energized. More preferably, the counter 89 is incremented each time at least one of the driver circuits 88 are energized. The counter 89 is a binary counter which can be stored in the memory element 48. The number of times that the driver circuits 88 are energized is representative of the number of drops of ink that have been expelled by the cartridge 40. In the preferred embodiment, the cartridge 40 stores 120 ml of ink. Assuming one drop of ink equals about 140 picoliters of ink, a 120 ml cartridge can hold approximately 857 million drops of ink. In the preferred embodiment, the counter 89 is a 32-bit binary counter which can easily count up to 857 million. The number of drops of ink that have been expelled by the cartridge 40 (FIG. 2) can be determined by reading the number in the counter 89. Preferably, the value of the counter 89 is stored in the memory storage element 48 at a specified time interval, as per an instruction received by the logic block 86.

In an alternate embodiment, the counter 79 is a binary counter which is set to count to a specified number. After the counter 89 reaches the specified number, the counter 89 outputs a bit indicating that the maximum value of the counter 89 has been reached and the counter 89 resets itself to zero. Each time the counter reaches its maximum value, the output bit is stored in the memory element 48. Thus, in the alternate embodiment, an approximate number of drops of ink that have been expelled by the cartridge 40 can be calculated by multiplying the number of bits stored in the memory storage element 48 by the maximum value of the counter 89. The maximum value of the counter 89 should be able to count a number of drops which is equivalent to approximately 3–5% of the total volume of ink stored in the cartridge 40. If the counter is to be able to count a number of drops equivalent to 3–5% of the total volume of ink, the maximum value of the counter is approximately 40 million. If the cartridge hold 120 ml of ink, the maximum value of the binary counter in the alternate embodiment is $2^{25}$. In the alternate embodiment, the number of drops of ink that have been expelled by the cartridge 40 can be calculated by multiplying the number of data bits stored in the memory storage element 48 by said maximum value of the counter 89.

Preferably, the initial ink volume in drops of ink is stored in the memory storage element 48. With the capacity of the ink jet cartridge stored in the memory element 48 and from the number of drops of ink that have been utilized, represented by the value stored in the memory storage element 48, the logic block 86 can calculate the number of drops of ink that are remaining in the ink jet cartridge. It is desirable to have access to the approximate amount of ink remaining in the cartridge before a large print job is started. In many cases large print jobs are run at night when no one is around to monitor the printing. Therefore, it would be advantageous to be able to determine how much ink is remaining in the print cartridge 40 before a large overnight print job is run. If the amount of ink remaining in the cartridge 40 is low, the cartridge 40 can be changed before the print job is started.

In a preferred embodiment, the memory storage element 48 is capable of storing information regarding the printer ink cartridge 40 and the ink stored within the cartridge 40. An exemplary list of data that the memory storage element 48 can store is as follows: ink type, ink color, lot number of the ink, date of manufacture of the cartridge, data from a spectral analysis of the ink, initial amount of ink stored in the cartridge body, amount of ink delivered, and amount of ink remaining in the cartridge. Other types of data that may be desirable to store in the memory storage element 48 is data related to the types of printers with which the cartridge 40 can operate, such as the maximum rate of ink droplet deposition of which the printer is capable, carriage speed, one way or bi-directional printing capabilities, etc. As will be recognized by those of skill in that art, any type of data can be stored in the memory storage element 48 and the above lists are considered exemplary of the types of data that may be desirable to be stored and should by no means be considered exhaustive.

Figure 6:
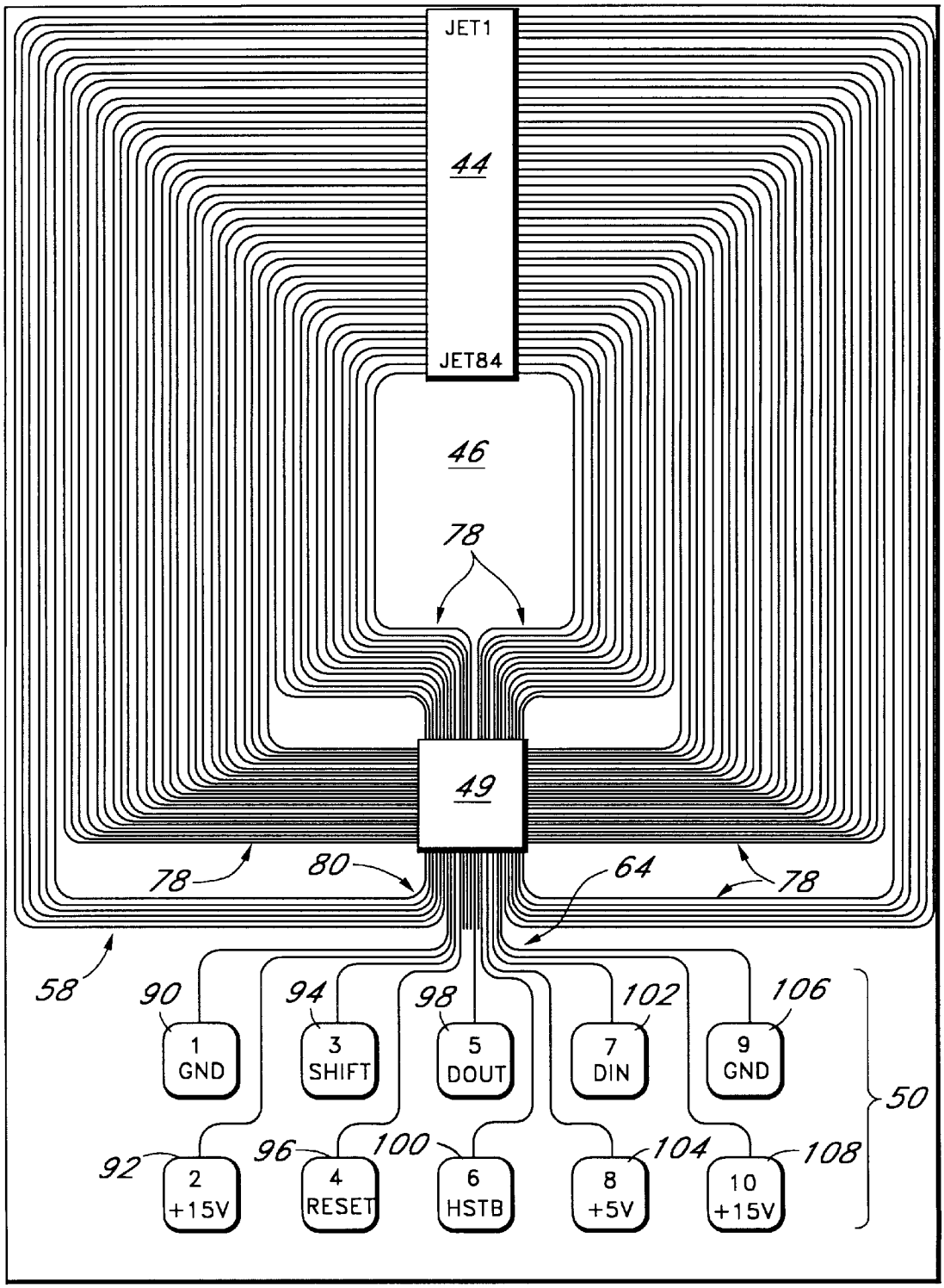
FIG. 6 is a schematic diagram of the connection of the jets on the jet plate to the integrated circuit on the cartridge and the connection from the integrated circuit to the exposed electrical contacts.

FIG. 6 is a schematic diagram of the currently preferred layout of the first plurality of electrical conductors 58 connecting the jet plate assembly 44 to the integrated circuit 49 and of the second plurality of electrical conductors 64 connecting the integrated circuit 49 to the contacts 50 on the flexible connector 46. The first plurality of conductors 58 is further broken down into a set of driver conductors 78 and a set of bank control conductors 80. In the preferred embodiment, the first plurality of electrical conductors 58 comprises ninety conductors, i.e., a set of eight-four driver conductors 78 and a set of six control conductors 80. The second set of conductors 64 comprises ten conductors, i.e., one conductor for each contact 50. The ten contacts 50 preferably carry the following power and control signals from the external device, such as a printer: the first ground signal 90, the first +15V power signal 92, the shift signal 94, the reset signal 96, the DATA OUT (DOUT) signal 98, the head strobe (HTSB) signal 100, the DATA IN (DIN) signal 102, the +5V power signal 104, the second ground signal 106 and the second +15V signal 108, respectively. All of the signals from the external system 91 that are sent through the contacts 50 are delivered directly to the integrated circuit 49. The control and driver circuit 47 on the integrated circuit 49 operates on the signals from the external device as described above to generate the driver signals 78 and the control signals 80. The driver signals 78 and control signals 80 generated on the integrated circuit 49 are routed directly to the jet plate assembly 44. As will be recognized by one of skill in the art, a number of different wiring layouts of the first plurality and the second plurality of electrical conductors 58, 64 are possible. The wiring layout of FIG. 6 is the currently preferred wiring layout, however any number of other operable layouts may be substituted for the illustrated embodiment without effecting the operation of the ink cartridge 40 of the present invention.

Figure 7:
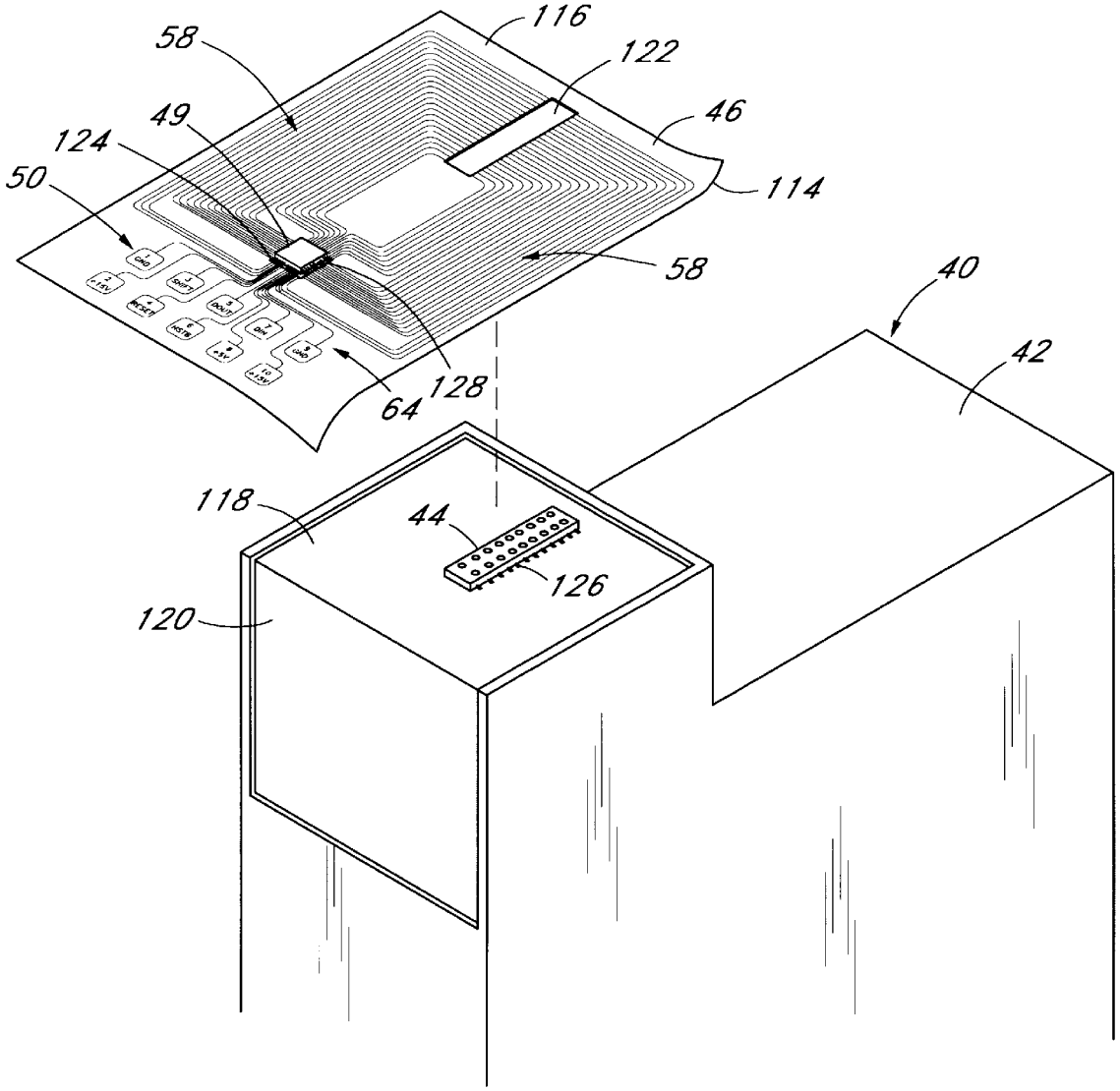
FIG. 7 is an exploded perspective view of the printer ink cartridge illustrated in FIG. 2.

Referring to FIG. 7, the assembly of the jet plate assembly 44, the flexible connector 46 and the integrated circuit 49 to the body 42 of the printer ink cartridge 40 is described as follows. The first and second plurality of electrical conductors 58, 64 are preferably formed as electrical traces on a first side 114 of the flexible connector 46 utilizing a conventional photolithographic etching process. The first plurality of electrical contacts 50 are located on a second side 116 of the flexible connector 46. An electrical connection from each of the second plurality of electrical conductors 64 on the first side 114 of the flexible connector 46 is made to the appropriate contacts 50 on the second side 116 of the flexible connector 46 by a through hole (not shown) formed in the connector 46.

The flexible connector 46 comprises a first opening 122 and a connecting pad 124. The integrated circuit 49 is bonded to the connecting pad 124 utilizing an adhesive bond. The first and second plurality of electrical conductors 58, 64 on the flexible connector 46 which connect to the integrated circuit 48\9 terminate at the connecting pad 124 and are aligned with a plurality of mating electrical contacts 128 on the integrated circuit 49. Preferably, the integrated circuit 49 is connected to the first and second plurality of electrical conductors 58, 64 on the flexible connector 46 by a Tape Automated Bonding (TAB) mounting process, known to those of skill in the art.

The jet plate assembly 44 is bonded to a bottom side 118 of the cartridge body 42 utilizing an adhesive bond. When the cartridge is assembled, the jet plate assembly 44 protrudes through the first opening 122 in the flexible connector 46. The first plurality of electrical connector elements 58 on the flexible connector 46 that connect to the jet plate assembly 44 terminate at the first opening 122 and are aligned with a first plurality of mating electrical contacts 126 on the jet plate assembly 44. The flexible connector 46 is aligned with the cartridge body 42 such that the first opening 122 in the connector 46 is aligned with the jet plate assembly 44 on the bottom side 118 of the cartridge body 42 and the connecting pad 124 and the integrated circuit 49 are aligned with a first side 120 of the cartridge body 42. After proper alignment has been achieved, the first side 114 of the flexible connector 46 is bonded to both the bottom side 118 and the first side 120 of the cartridge body 42 utilizing the Tape Automated Bonding (TAB) mounting process, a process known to those of skill in the art.

In an alternate embodiment, the integrated circuit is connected to the flexible connector 46 utilizing the chip-on-board mounting process, a process which is known to those of skill in the art. In the chip-on-board mounting process, the first and second plurality of electrical conductors 58, 64 terminate at a third plurality of contacts (not shown) proximate to the connecting pad 124 on the flexible connector 46. The third plurality of electrical contacts are connected to the mating contacts 128 on the integrated circuit 49 by a direct wiring method, i.e., one end of a wire (not shown) is bonded onto one of the electrical contacts and a second end of the wire is bonded to a corresponding one of the mating contacts 128. After all of the contacts are connected to the mating contacts 128, the integrated circuit 49, the wires and the contacts are covered with a polymeric protective coating, such as epoxy.

In another alternate embodiment, the integrated circuit 49 is connected to the flexible connector 46 utilizing the surface mount (SMT) mounting process, which is known to those of skill in the art. In the surface mount mounting process, the first and second plurality of electrical conductors 58, 64 terminate at a third plurality of contacts (not shown) proximate to the second opening 124 on the flexible connector 46. The mating contacts 128 on the integrated circuit 49 are arranged such that the mating contacts 128 come into direct contact with a corresponding one of the third plurality of electrical contacts. The mating contacts 128 and the electrical contacts are soldered together. After the soldering is complete, the integrated circuit 49, the mating contacts 128, and the electrical contacts are covered with a polymeric protective coating, such as epoxy.

In another alternate embodiment, the integrated circuit is attached using a flip chip mounting process, which is known to those of skill in the art. In the flip chip mounting process, solder balls on the mating connectors 128 of the integrated circuit 49 are pressed against the flexible connector 46 and heated until the solder melts, thus connecting the integrated circuit 49 to the flexible connector 46.

Advantageously, by adding the control and driver circuit 47 to the printer ink cartridge 40, the number of electrical contacts 50 required to interface with an external devices is decreased. With fewer electrical contacts 50, the number of physical problems in the field caused by improper connection of the printer ink cartridge 40 to the external device, such as a printer, decreases. Therefore, the reliability of the printer ink cartridge 40 increases. In addition, several design problems were eliminated when the number of electrical contacts 50 was decreased from ninety contacts, i.e., the number of the first plurality of conductors 54 required to operate an eighty-four nozzle jet plate 44, to ten external contacts 50. The reduced number of external contacts 50 also decreased the manufacturing costs and increases the mechanical interconnect reliability costs, since the contacts 50 are expensive to manufacture.

As discussed above, locating the control and driver circuit 47 on the printer ink cartridge 40 improves the performance of the printing process. By moving the control and driver circuit 47 onto the cartridge 40, the efficiency of the drive signals is improved and the cartridge 40 can be run at a faster bandwidth, i.e., the user can print faster. In addition, the noise and voltage fluctuations to the driver circuits 88 are also reduced, therefore the ink is heated more consistently so an improved consistency of drops of ink on the paper is achieved.

Further, by moving the control and driver circuit 47 onto the cartridge 42 without integrating the circuit 47 on to the jet plate 44, the complexity of manufacturing the jet plate 44 is reduced. As described above, several additional processes are required to manufacture a jet plate 44 that can withstand the heat generated by the heating elements 72 and that will not react with the ink that comes into contact with the jet plate 44. These additional processes required for the heating elements 72 and to protect the silicon from reacting with the chemicals in the ink may reduce the performance characteristics of the control and driver circuit 47, which is not desirable. Further, these additional processes and the increased size of a jet plate assembly 44 that includes both the heating elements 72 and the control and driver logic circuit 47 increase the reliability problems associated with the jet plate 44. By forming two separate devices, i.e., a control and driver circuit 47 and a jet plate 44 with or without any driver or control logic, each device can be optimized for its intended operational parameters. If the control and driver circuit 47 is not part of the jet plate 44, these additional processes do not have to be performed on the integrated circuit 49 which houses the control and driver circuit 47. In addition, each device is a small circuit which can be easily manufactured resulting in a higher yield rate than a large circuit which would combine the electronics on both devices. Further, by having a separate integrated circuit 49, different manufacturing processes do not have to be mixed. Lastly, the size of the jet plate 44, i.e., the number of jets, can be more easily scaled up or down without directly affecting the size of the silicon based jet plate assembly, because the heating elements 72 on the jet plate 44 in the preferred embodiment are not formed from or on silicon. Rather, the heating elements, i.e., resistors, are formed utilizing thick film and thin film technology on a substrate. These thick film and thin film processes can be scaled much more easily than scaling a silicon heating element without deceasing the yield of the jet plate.

Finally, by adding the memory storage element 48 to the cartridge 40 the cartridge 40 is able to nonvolatilely store data related to the cartridge 40 and the ink stored within the cartridge 40. Advantageously, the cartridge user does not have to physically review information on the label of the cartridge 40 to ascertain information about the cartridge 40 as the printer system or an external device can access the memory storage element 48 on the cartridge 40 to retrieve the necessary information. The memory storage element 48 is able to store a larger volume of information than can be printed on the label of the cartridge 40, thus enabling information which is not usually available to the printer, such as ink type, lot number of the ink, date of manufacture of the cartridge and data from a spectral analysis of the ink, to be stored on the cartridge 40. In addition, if the label is accidently destroyed or removed from the cartridge 40, the printer can always access the information stored in the memory storage element 48 to determine the desired information.

Further, by incorporating a memory storage element 48 on the cartridge 40, data regarding the approximate number of ink drops expelled from the cartridge 40 can be read from the memory storage element 49. As described above, the counter 89 counts the number of times a driver circuit 88 connected to one of the heating elements 72 is energized. From this approximate number of ink drops expelled, the printer can automatically determine the approximate amount of ink remaining in the cartridge 40 and warn the user if the ink supply is running low. Further, by counting the number of drops of ink that have been fired by the cartridge 40, the user can be warned when the cartridge 40 needs to be serviced and/or replaced. For example, if after two refills of ink the cartridge 40 needs to be serviced, once the stored number of drops of ink is indicative of two refills of ink, the user will receive a warning message indicating that service of the cartridge 40 is advised. Thus, the addition of the memory storage element 48 not only adds significant memory storage capabilities to the cartridge 40, but also enables the implementation of additional features to the cartridge 40.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. In an ink jet printer comprising a movable print carriage and a printer cartridge mounted in said movable print carriage, said printer cartridge having a bottom surface with a jet plate comprising a plurality of ink ejection orifices mounted thereto; a method of accessing and using information stored in a memory storage element on said printer ink cartridge, said method comprising:

mounting said memory storage element on said printer ink cartridge on a side surface of said printer ink cartridge which also contains electrical contacts for electronically interfacing with said movable print carriage;

storing in said memory storage element data indicative of an amount of ink expelled by said cartridge, said amount being greater than an ink storage capacity of said printer cartridge;

routing said data from said memory storage element to an external device;

analyzing said data in said external device to determine if said cartridge should be replaced; and providing an indication to an operator of said printer that said printer cartridge should be replaced in response to said analysis.

2. The method of claim 1, wherein said data is stored at an addressable memory location, and wherein said routing comprises initially sending address information from said external device to said memory storage element.

3. A printer cartridge comprising:

a housing comprising a bottom surface and a side surface joined at a corner of said housing;

a jet plate mounted to said bottom surface;

a flexible connector having first and second portions, wherein said first portion is affixed to said bottom surface and coupled to said jet plate, wherein said flexible connector extends from said jet plate, around said corner of said housing, and onto said side surface of said housing such that said second portion is affixed to said side surface;

a plurality of electrical contacts integral to said second portion of said flexible connector;

an integrated circuit comprising a memory element mounted to said side surface adjacent to said plurality of electrical contacts.

4. The printer cartridge of claim 3, wherein said memory element comprises an addressable EEPROM.

5. The printer cartridge of claim 3, wherein said integrated circuit additionally comprises logic and driver circuitry electrically connected to said jet plate.

* * * * *